US009493220B2

(12) United States Patent
Kirchhoff et al.

(10) Patent No.: US 9,493,220 B2
(45) **Date of Patent: *Nov. 15, 2016**

(54) SYSTEMS AND METHODS FOR CONTROLLING SHIFT IN MARINE PROPULSION DEVICES

(71) Applicant: Brunswick Corporation, Lake Forest, IL (US)

(72) Inventors: Thomas S. Kirchhoff, Fond du Lac, WI (US); David G. Camp, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 100 days.

This patent is subject to a terminal disclaimer.

(21) Appl. No.: 14/587,113

(22) Filed: Dec. 31, 2014

(65) Prior Publication Data

US 2015/0112521 A1 Apr. 23, 2015

Related U.S. Application Data

(62) Division of application No. 13/462,570, filed on May 2, 2012, now Pat. No. 8,961,246.

(51) Int. Cl.

| | |
|---|---|
| ***B63H 21/21*** | (2006.01) |
| ***B63H 21/22*** | (2006.01) |
| ***B63H 20/00*** | (2006.01) |
| ***F02B 61/04*** | (2006.01) |
| ***F02D 41/02*** | (2006.01) |
| ***F02D 31/00*** | (2006.01) |
| *F02D 11/02* | (2006.01) |

(52) U.S. Cl.

CPC ..... *B63H 21/213* (2013.01); *B63H 21/21* (2013.01); *B63H 21/22* (2013.01); *F02B 61/045* (2013.01); *F02D 31/002* (2013.01); *F02D 41/023* (2013.01); *F02D 41/0225* (2013.01); *B63H 2021/216* (2013.01); *F02D 11/02* (2013.01); *F02D 2200/0404* (2013.01); *Y10T 477/675* (2015.01); *Y10T 477/677* (2015.01)

(58) Field of Classification Search

CPC .... B63H 21/213; B63H 21/22; B63H 21/21; B63H 2021/216; F02B 61/045; F02D 31/002; F02D 41/023; F02D 41/0225; F02D 2200/0404; F02D 11/02; Y10T 477/675; Y10T 477/677

USPC ..... 440/1, 84, 86, 87; 477/107, 109–113; 701/21

See application file for complete search history.

(56) References Cited

U.S. PATENT DOCUMENTS

| | | | |
|---|---|---|---|
| 4,257,506 | A | 3/1981 | Bankstahl |
| 4,753,618 | A | 6/1988 | Entringer |
| 4,843,914 | A | 7/1989 | Koike |

(Continued)

*Primary Examiner* — Ajay Vasudeva

(74) *Attorney, Agent, or Firm* — Andrus Intellectual Property Law, LLP

(57) ABSTRACT

Systems and methods are for controlling shift in a marine propulsion device. A shift sensor outputs a position signal representing a current position of a shift linkage. A control circuit is programmed to identify an impending shift change when the position signal reaches a first threshold and an actual shift change when the position signal reaches a second threshold. The control circuit is programmed to enact a shift interrupt control strategy that facilitates the actual shift change when the position signal reaches the first threshold, and to actively modify the first threshold as a change in operation of the marine propulsion device occurs.

20 Claims, 7 Drawing Sheets

(56) References Cited

U.S. PATENT DOCUMENTS

| | | | | |
|---|---|---|---|---|
| 4,843,915 | A | 7/1989 | Sugimura et al. | |
| 4,903,662 | A | 2/1990 | Hirukawa et al. | |
| 4,952,181 | A | 8/1990 | Entringer et al. | |
| 4,986,776 | A | 1/1991 | Hensel et al. | |
| 5,050,461 | A | 9/1991 | Onoue et al. | |
| 5,403,246 | A | 4/1995 | Umemoto | |
| 5,665,025 | A | 9/1997 | Katoh | |
| 5,827,150 | A | 10/1998 | Mukumoto | |
| 5,836,851 | A | 11/1998 | Ruman | |
| 5,853,306 | A | 12/1998 | Worth et al. | |
| 6,273,771 | B1 | 8/2001 | Buckley et al. | |
| 6,544,083 | B1 | 4/2003 | Sawyer et al. | |
| 6,692,320 | B1 | 2/2004 | Sawyer | |
| 6,863,580 | B2 | 3/2005 | Okuyama | |
| 6,929,518 | B1 | 8/2005 | Sawyer et al. | |
| 6,942,530 | B1 | 9/2005 | Hall et al. | |
| 7,214,164 | B2 | 5/2007 | Shomura et al. | |
| 7,267,593 | B2 | 9/2007 | Oguma et al. | |
| 7,836,787 | B2 | 11/2010 | Oguma | |
| 8,798,823 | B2 | 8/2014 | Sakaguchi et al. | |
| 8,961,246 | B1 * | 2/2015 | Kirchhoff | B63H 21/21 440/1 |
| 9,043,058 | B1 * | 5/2015 | Camp | B63H 23/02 701/21 |

* cited by examiner

SYSTEMS AND METHODS FOR CONTROLLING SHIFT IN MARINE PROPULSION DEVICES

CROSS REFERENCE TO RELATED APPLICATION

This application is a divisional of U.S. patent application Ser. No. 13/462,570, filed May 2, 2012, which is incorporated herein by reference, now U.S. Pat. No. 8,961,246.

FIELD

The present disclosure relates to marine propulsion devices, and more particularly to systems and methods for controlling shift in marine propulsion devices.

BACKGROUND

U.S. Pat. No. 6,942,530, the disclosure of which is incorporated herein by reference in entirety, discloses an engine control strategy for a marine propulsion system that selects a desired idle speed for use during a shift event based on boat speed and engine temperature. In order to change the engine operating speed to the desired idle speed during the shift event, ignition timing is altered and the status of an idle air control valve is changed. These changes to the ignition timing and the idle air control valve are made in order to achieve the desired engine idle speed during the shift event. The idle speed during the shift event is selected so that the impact shock and resulting noise of the shift event can be decreased without causing the engine to stall.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In some examples, methods of controlling shift in a marine propulsion device comprise: sensing a position of a shift linkage as a change in operation of the marine propulsion device occurs; communicating the sensed position of the shift linkage to a control circuit; and modifying, based upon the sensed position of the shift linkage, a threshold for the control circuit to initiate a change in engine speed to facilitate a shift event. The change in operation of the marine propulsion device can comprise a change in position of a throttle valve of a marine engine associated with the marine propulsion device.

In other examples, shift control systems for a marine propulsion device comprise: a control lever; a shift linkage operably connected with the control lever so as to cause a shift change in the marine propulsion device upon movement of the control lever; a shift sensor outputting a position signal representing a current position of the shift linkage; and a control circuit that is programmed to identify an impending shift change when the position signal reaches a first threshold and an actual shift change when the position signal reaches a second threshold. The control circuit is programmed to enact a shift interrupt control strategy that facilitates the shift change when the position signal reaches the first threshold. The control circuit is further programmed to actively modify the first threshold as a change in operation of the marine propulsion device occurs.

In other examples, methods of controlling shift in a marine propulsion device comprise: sensing a current position of a shift linkage in the marine propulsion device; providing a position signal representing the current position of the shift linkage; and operating a control circuit to i) identify an impending shift change when the position signal reaches a first threshold and a shift change when the position signal reaches a second threshold, ii) enact a shift interrupt control strategy that facilitates the actual shift change when the position signal reaches the first threshold; and iii) actively modify the first threshold as a change in operation of the marine propulsion device occurs.

Various other aspects and exemplary combinations for these examples are further described herein below.

BRIEF DESCRIPTION OF THE DRAWINGS

Examples of methods and systems for controlling shift in marine propulsion devices are described with reference to the following figures. The same numbers are used throughout the figures to reference like features and components.

DETAILED DESCRIPTION OF THE DRAWINGS

In the present description, certain terms have been used for brevity, clearness and understanding. No unnecessary limitations are to be inferred therefrom beyond the requirement of the prior art because such terms are used for descriptive purposes only and are intended to be broadly construed. The different methods and systems described herein may be used alone or in combination with other methods and systems. Various equivalents, alternatives, and modifications are possible within the scope of the appended claims.

Figure 1:
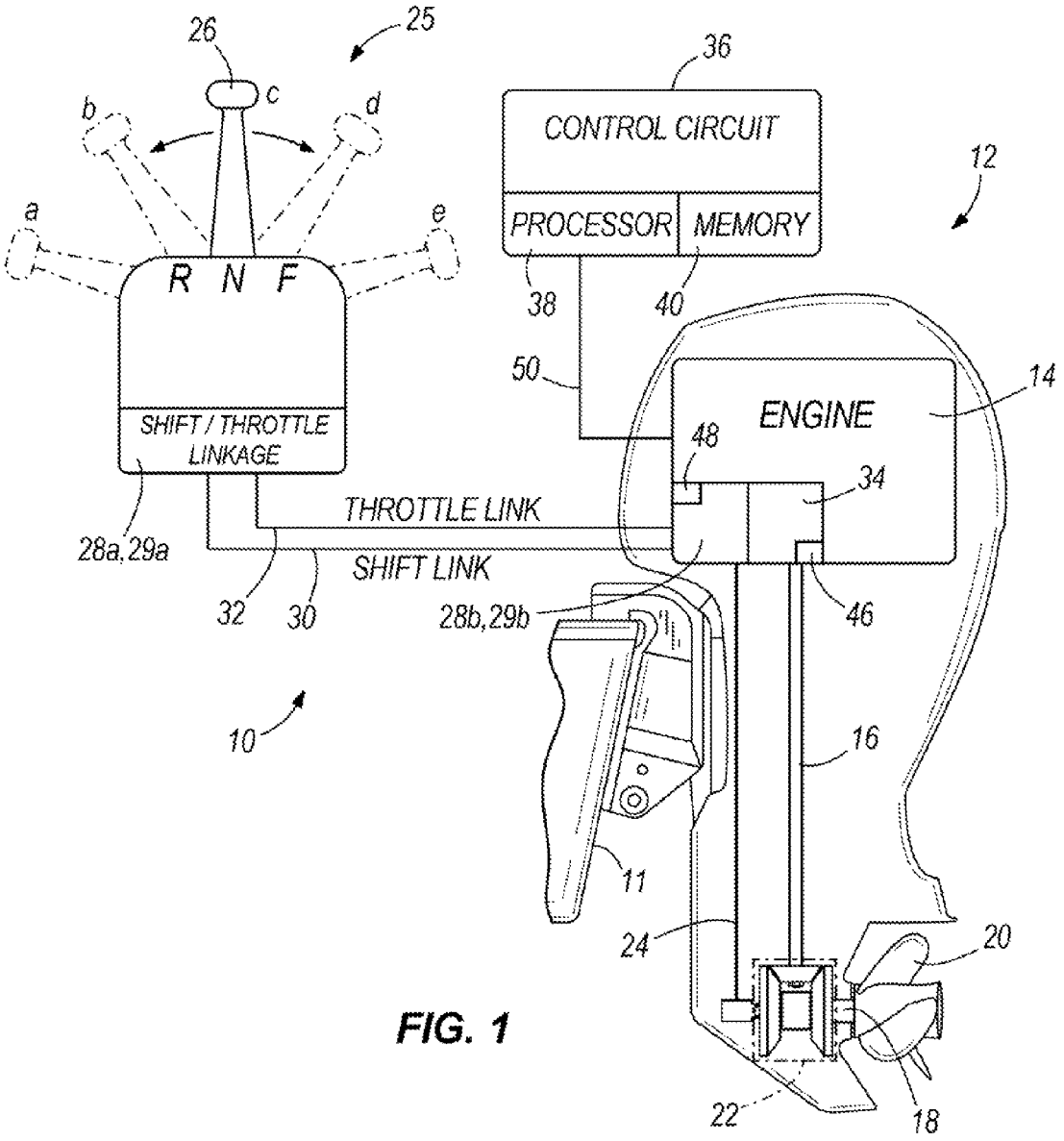
FIG. 1 is a schematic depiction of a shift control system for a marine propulsion device.

FIG. 1 depicts an exemplary shift control system 10 for a marine propulsion device 12 on a marine vessel 11. In the examples shown and described, the marine propulsion device 12 is an outboard motor; however the concepts of the present disclosure are not limited for use with outboard motors and can be implemented with other types of marine propulsion devices, such as inboard motors, inboard/outboard motors, hybrid electric marine propulsion systems, pod drives and/or the like. In the examples shown and described, the marine propulsion device 12 has an engine 14 causing rotation of a drive shaft 16 to thereby cause rotation of a propeller shaft 18. A propeller 20 connected to and rotating with the propeller shaft 18 propels the marine vessel 11 to which the marine propulsion device 12 is connected. The direction of rotation of propeller shaft 18 and propeller 20 is changeable by a clutch 22, which in the example shown is a conventional dog clutch; however many other types of clutches can instead or also be employed. As is conventional, the clutch 22 is actuated between forward gear, neutral gear and reverse gear by a shift rod 24.

The shift control system 10 also includes a remote control 25 having an operator control lever 26, which in the example of FIG. 1 is a combination shift/throttle lever that is pivotally movable between a reverse wide open throttle position 26*a*, a reverse detent position (zero throttle) 26*b*, a neutral position 26*c*, a forward detent position (zero throttle) 26*d* and a forward wide open throttle position 26*e*, as is conventional. The remote control 25 is typically located at the helm of the marine vessel 11. The control lever 26 is operably connected to a shift linkage 28 and a throttle linkage 29, such that pivoting movement of the control lever 26 can cause corresponding movement of the shift linkage 28 and such that pivoting movement of the control lever 26 can cause corresponding movement of the throttle linkage 29. Portions 28*a* of the shift linkage 28 are typically located at the remote control 25 and other portions 28*b* of the shift linkage 28 are located at the engine 14. Similarly, portions 29*a* of the throttle linkage 29 are typically located at the remote control 25 and other portions 29*b* of the shift linkage 29 are located at the engine 14. The shift linkage 28 also includes a shift link 30 that translates movement of the control lever 26 to the marine propulsion device 12, and ultimately to the shift rod 24, for causing a shift event (i.e. a change in gear) in the clutch 22. The shift link 30 can be for example a cable and/or the like. The throttle linkage 29 includes a throttle link 32 that translates movement of the control lever 26 to the engine 14 of the marine propulsion device 12, and ultimately to change the position of a throttle valve 34 of the engine 14. The throttle link 32 can be for example a cable and/or the like.

The shift control system 10 also includes a control circuit 36 that is programmable and includes a microprocessor 38 and a memory 40. The control circuit 36 can be located anywhere in the shift control system 10 and/or located remote from the shift control system 10 and can communicate with various components of the marine vessel 11 via wired and/or wireless links, as will be explained further herein below. The control circuit 36 can have one or more microprocessors that are located together or remote from each other in the shift control system 10 or remote from the system 10. Although FIG. 1 shows a single control circuit 36, the shift control system 10 can include more than one control circuit 36. For example, the shift control system 10 can have a control circuit 36 located at or near the control lever 26 and can also have a control circuit 36 located at or near the marine propulsion device 12. Each control circuit 36 can have one or more control sections. One having ordinary skill in the art will recognize that the control circuit 36 can have many different forms and is not limited to the example that is shown and described.

In this example, the control circuit 36 communicates with one or more components of the marine propulsion device 12 via a communication link 50, which can be a wired or wireless link. The control circuit 36 is capable of monitoring and controlling one or more operational characteristics of the marine propulsion device 12 by sending and receiving control signals via the communication link 50. In this example, a throttle valve 34 is provided on the engine 14 and a throttle valve position sensor 46 senses the position of the throttle valve 34, which is movable between open and closed positions. The throttle valve position sensor 46 provides signals to the control circuit 36 via the link 50 indicating the current position of the throttle valve 34.

The control circuit 36 is also configured to at least receive position signals from a shift sensor 48 sensing a current position of the shift linkage 28. The control circuit 36 communicates with the shift sensor 48 via the communication link 50, which can be a wired or wireless link. In this example, the shift sensor 48 includes a potentiometer and an electronic converter, such as an analog to digital converter that outputs discrete analog to digital (ADC) counts that each represent a position of the shift linkage 28. Such potentiometer and electronic converter combinations are known in the art and commercially available for example available from CTS Corporation.

Figure 2:
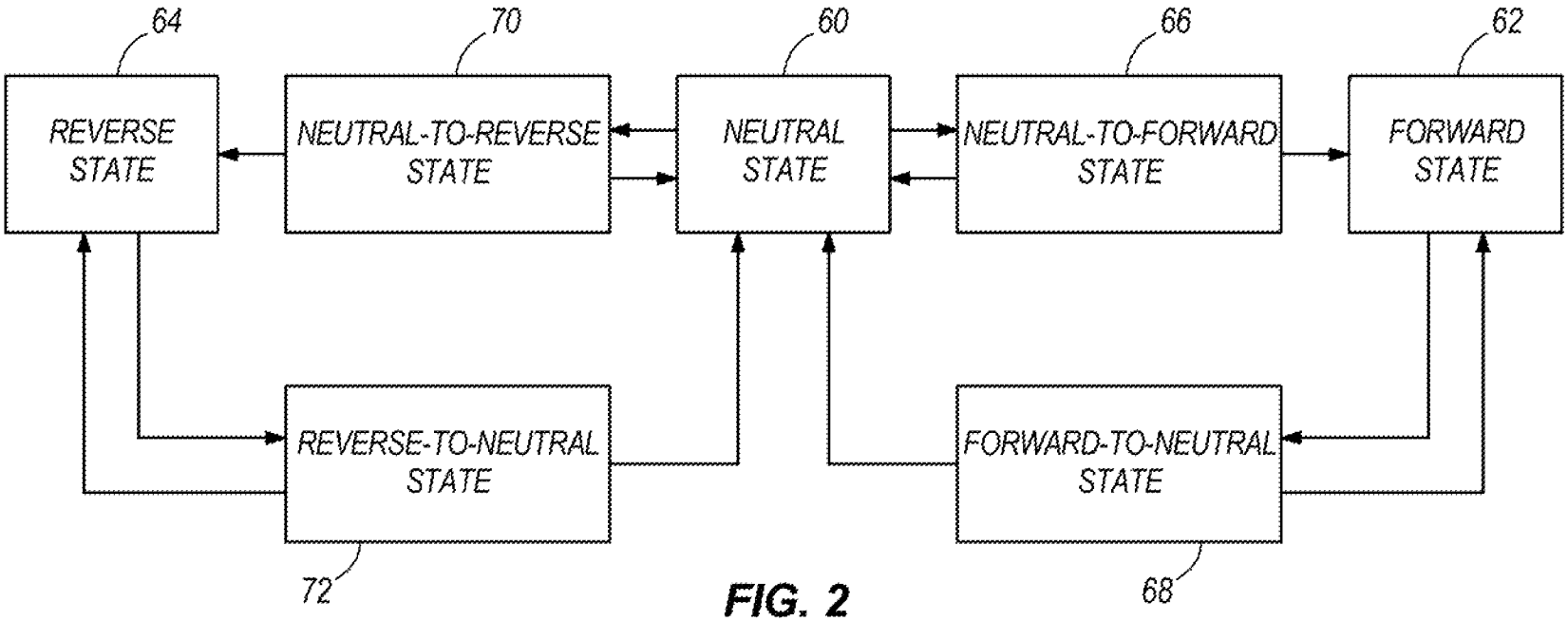
FIG. 2 is a state flow diagram depicting states of a shift control system for a marine propulsion device.

FIG. 2 is a stateflow diagram depicting several different operational modes or "control states" of the control circuit 36. In each control state, the control circuit 36 follows a protocol, as will be explained further herein below, to obtain a desired functional/operational output from the marine propulsion device 12 that is commensurate with operator inputs to the control lever 26. In this example, the control circuit 36 is programmed to control the speed of the engine 14 based upon a current position of the control lever 26 about its pivot axis. More specifically, as the control lever 26 is pivoted, the shift sensor 48 outputs discrete ADC counts to the control circuit 36 based upon the position of the shift linkage 28. Each ADC count corresponds to a position of the control lever 26 with respect to its pivot access. As will be explained further herein below, the control circuit 36 compares the current ADC count to a threshold and then commands that the engine 14 of the marine propulsion device 12 act according to a certain control state based upon the comparison, to thereby facilitate easier shifting by the device 12.

As described in the incorporated U.S. Pat. No. 6,942,530, shifting from one gear position to another gear position (such as from neutral gear to forward gear) can often result in significant impact noise and/or impact shock to the marine propulsion device, and particularly its drive components. This noise and/or shock results from the impact that occurs between moving parts of the clutch 22, for example. The amount of noise and/or shock is often proportional to the speed of the engine 14. The faster the speed of the engine 14, the more noise and/or shock, and vice versa. Shifting from one gear position to another gear position (such as from forward gear to neutral gear) can often cause a significant load to be placed on the shift mechanism. The faster the speed of the engine 14, the more load on the shift mechanism, and vice versa. During a shift event, it can therefore be desirable to briefly reduce the speed of the engine 14 in order to facilitate a shift event having less noise and/or shock and/or a shift event encountering reduced load. The speed of the engine 14 can be reduced by implementing one of several known shift interrupt control strategies, several of which are disclosed in the above referenced U.S. Pat. No. 6,942,530, which are described in the context of reducing noise and/or shock. These shift interrupt control strategies can also be used to reduce the load. Shift interrupt control strategies can include varying spark ignition, varying engine torque profile, interrupting ignition, reducing engine torque, varying throttle valve position, interrupting engine ignition circuit, cutting fuel, opening the idle air control valve, just to name just a few. Implementing any one of these shift interrupt control strategies can cause the speed of the engine 14 to slow, thus decreasing the torque provided to the drive train, including the noted clutch 22.

In the present disclosure, the control circuit 36 is programmed to enact a selected shift interrupt control strategy that briefly lowers the speed of the engine when the position signal provided by the shift sensor 48 reaches a threshold. As will be explained further herein below, advantageously, the control circuit 36 is also programmed to actively modify one or more threshold as a change in operation of the marine propulsion device 12 occurs, such as for example a change in a position of the throttle valve 34, as sensed by the throttle valve position sensor 46.

As explained herein above, the control circuit 36 is programmed to compare the current position signal (here an ADC count) outputted by the shift sensor 48 to a threshold. When the position signal reaches the threshold, the control circuit 36 enacts a new control state. It should be understood that the control circuit 36 can follow generally the same protocol during a shift from neutral gear to reverse gear as it does during a shift from neutral gear to forward gear. Also, the control circuit 36 can follow generally the same protocol during a shift from reverse gear to neutral gear as it does during a shift from forward gear to neutral gear. As such, for discussion purposes and for brevity, an exemplary control circuit 36 protocol during a shift from neutral gear to forward gear, and back to neutral gear is discussed herein below.

Referring to FIG. 2, the control circuit 36 can be programmed with a threshold indicating a change from a Neutral State 60 to a Neutral-to-Forward State 66 in which the control circuit 36 can optionally be programmed to enact a shift interrupt control strategy, as described herein above. The control circuit 36 can also be programmed with another threshold indicating a change from Neutral-to-Forward State 66 to Forward State 62, at which point the control circuit 36 can optionally be programmed to stop enacting the noted shift interrupt control strategy. The control circuit 36 can further be programmed with another threshold indicating a change from the Forward State 62 to a Forward-to-Neutral State 68 during which state the control circuit 36 can be programmed to enact one or more of the noted shift interrupt control strategies. The value of the threshold indicating a change from Forward State 62 to Forward-to-Neutral State 68 can be different than the value of the threshold indicating a change from Neutral-to-Forward State 66 to Forward State 62. The control circuit 36 can be programmed with another threshold indicating a change from Forward-to-Neutral State 68 to the Neutral State 60, wherein the control circuit 36 can be programmed to stop enacting the noted shift interrupt strategy. As discussed above, this same type of protocol can apply in reverse, i.e. when a shift request is entered at the control lever 26 for neutral to reverse shift and thereafter for reverse to neutral shift, wherein the control circuit 36 is programmed to employ a Neutral-to-Reverse State 70, Reverse State 64, and Reverse-to-Neutral State 72.

As described herein above, the shift control system 10 is a mechanical system wherein manual inputs from the operator directly actuate the shift event. Thus the control circuit 36 has an observational role relative to the actual shifting event because the shifting event is largely controlled by mechanical connections in the marine propulsion device 12, including among other things the connections between the control lever 26, shift linkage 28, shift rod 24, and clutch 22. However the control circuit 36 can control characteristics of the engine 14 based upon the sensed operator inputs to the control lever 26 and more specifically based upon sensed movements of the shift linkage 28, for example. In this example, mechanical tolerances and connections between the noted control lever 26, shift linkage 28 (including portions 28*a*, 28*b* and shift link 30) will vary for each marine propulsion device 12. Because of this variability, the noted thresholds that are programmed in the control circuit 36 at the time the shift control system 10 is initially configured, which thresholds typically represent common or estimated positions of the shift linkage 28 at which a shift event most likely occurs, will not necessarily accurately reflect such a result in every system. The difference between the thresholds that are programmed when the shift control system 10 is initially configured and the actual positions at which changes in shift states occur can vary. For example, the position of the shift linkage 28, will not always accurately and/or precisely predict and/or represent the position at which an actual shift event occurs at the clutch 22. Each system will have slightly different physical characteristics, which causes the correlation between the position of the control lever 26 and actuation of the clutch 22 to vary and be unpredictable at the time of initial configuration of the shift control system 10.

Figure 3:
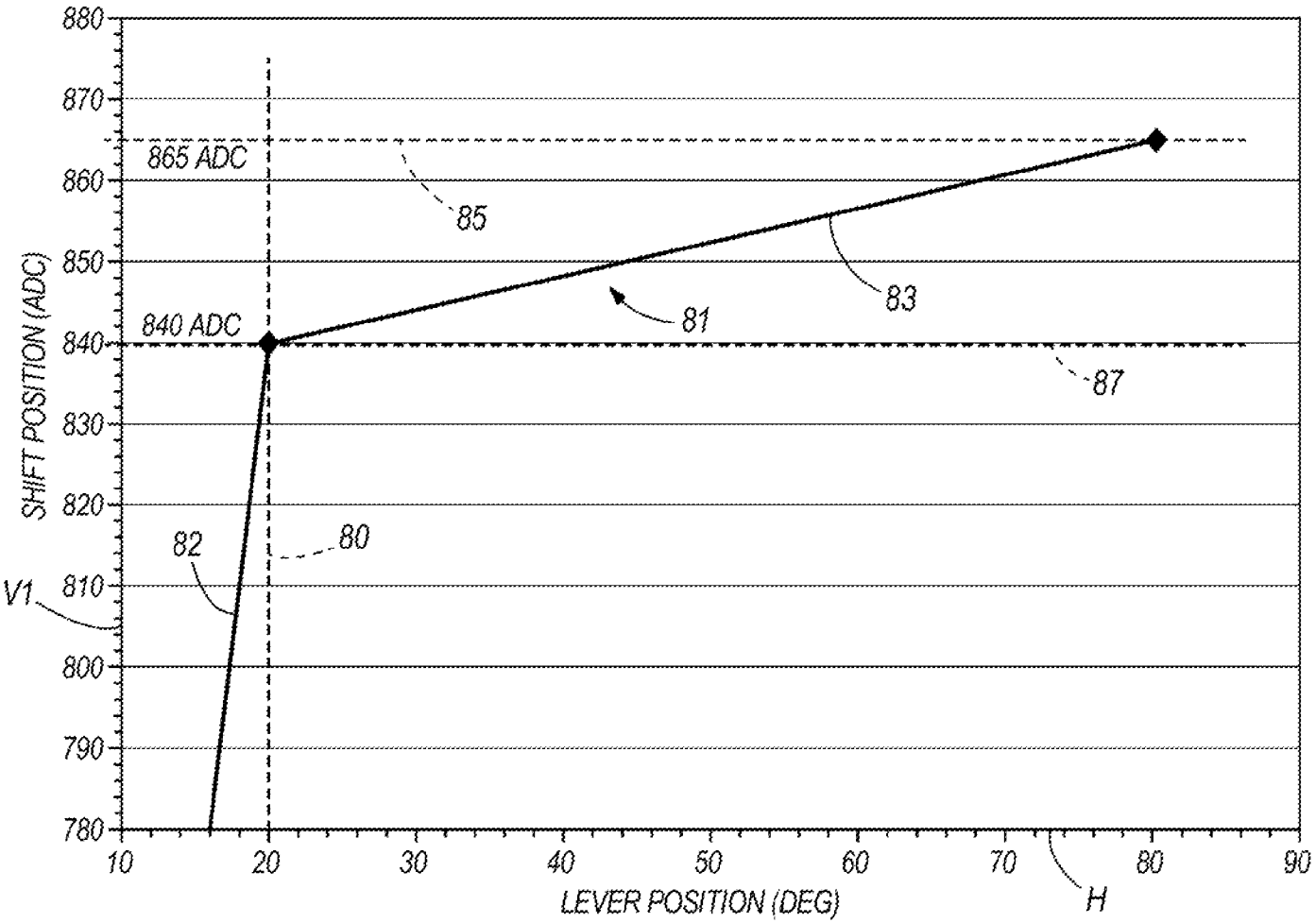
FIG. 3 is a graph depicting sensed movement of a shift linkage during a shift event.

FIG. 3 graphically depicts the above-described concepts in an exemplary shift linkage 28. The vertical axis V1 designates a range of analog to digital counts (ADC). The horizontal axis H designates a range of angular position of the control lever 26 with respect to a vertical or neutral N position. Dashed line 80 designates the angle of the control lever 26 at which a shift event actually occurs. In this example, the angle is twenty degrees. Solid line 81 designates the shift position signal (ADC) output by the shift sensor 48 as the control lever 26 is pivoted about its axis. In this example, the shift position signal is 840 ADC when the actual shift event occurs at the noted twenty degrees. Dashed horizontal line 85 represents an ADC count at which the shift linkage 28 stops moving. Dashed horizontal line 87 designates the position signal (here, 840 ADC) output by the shift sensor 48 when the actual shift event occurs. The line 81 thus has a first portion 82 that shows the shift position signal (ADC) up until when the actual shift event occurs at twenty degrees. The line 81 also has a second portion 83 that shows changes in the shift position signal (ADC) after the actual shift event occurs. Second portion 83 thus illustrates additional movement of the shift linkage 28 after the actual shift event has occurred. This is movement is lost or wasted motion in the mechanical system. More particularly, the second portion 83 illustrates lost motion in the shift linkage 28 (including the associated shift link 30) that occurs during movement of the control lever 26 from the forward detent position 26*d* to the forward wide open throttle position 26*c*. This motion of the shift linkage 28 does not impact or otherwise accurately predict the timing of the actual shift event. The slope and magnitude of second portion 83 will vary depending upon the particular marine propulsion device 12 and depending upon the particular thresholds that are selected, for example when the shift control system 10 is configured and the particular physical characteristics of the shift linkage 28.

Figure 4:
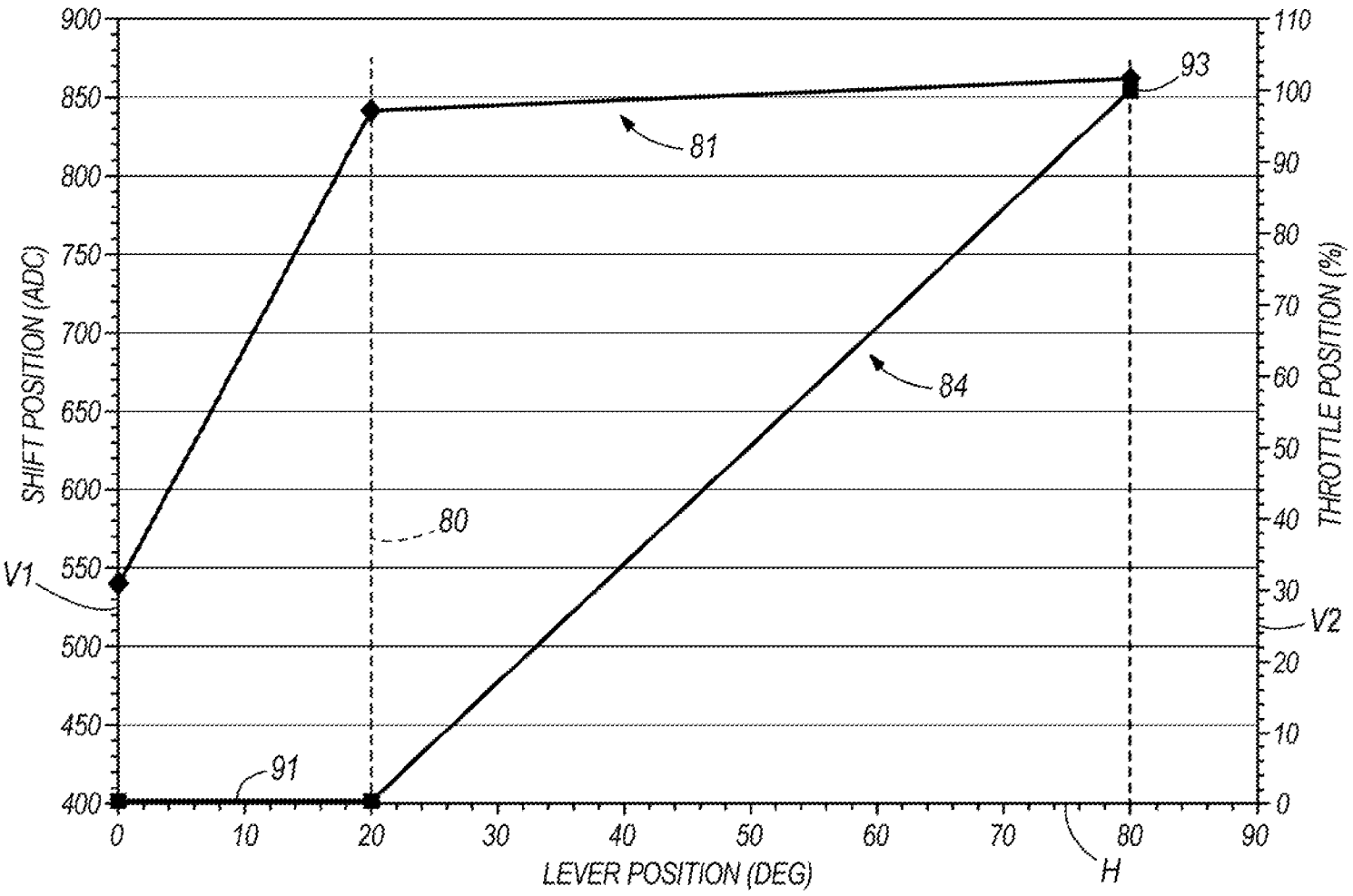
FIG. 4 is a graph depicting sensed movement of a shift linkage and a throttle linkage during a shift event.

Like FIG. 3, FIG. 4 depicts the shift position signal (solid line 81) that is output by the shift sensor 48. Line 84, FIG. 4, depicts the percent opening of the throttle valve 34 of the engine 14 during the movement of the control lever 26. Vertical axis V2 indicates the percent opening of throttle valve 34. Once the actual shift event occurs at twenty degree lever position, the throttle valve 34 gradually opens from a closed throttle valve position at 91 to a fully open throttle valve position at 93.

Through research and development efforts, the present inventors have recognized that because of unpredictability and lost motion encountered in mechanically based systems, it is desirable to provide a control system that actively modifies one or more of the noted thresholds for changing control states of the control circuit 36. By actively modifying these threshold(s), it is possible to more precisely (timely) implement shift interrupt control strategies prior to an actual shift event, which in turn provides efficiency in the shift change by for example reducing the impact and/or noise of the event. The inventors have also recognized that the shift control system 10 can be programmed to modify one or more noted thresholds, for example based upon movement of the throttle valve 34 between its closed and open state, which correlates to actual gear position of the marine propulsion device 12. By sensing the position of the throttle valve 34 and correlating throttle valve 34 position to the actual shift condition, the shift control system 10 is able to more accurately implement the shift interrupt control strategy at an optimal time. In other words, the throttle valve 34 will typically change position upon an actual shift event. This information can therefore be used by the control circuit 36 to modify the noted thresholds and more precisely implement the shift interrupt control strategy.

Referring back to FIG. 2, the shift control system 10 is programmed to actively modify one or more of the noted thresholds to achieve the above described advantages. For example, the threshold indicating a change from the Forward State 62 to the Forward-to-Neutral State 68 can be actively modified based upon a present condition of the throttle valve 34 associated with the engine 14. More specifically, the control circuit 36 can receive signals from the throttle valve position sensor 46 indicating the position of the throttle valve 34. The control circuit 36 can compare the signals it receives from the throttle valve position sensor 46 to a predetermined or calibratable amount, which can be for example a certain percent opening of the throttle valve 34. Until the signal from the throttle valve position sensor 46 reaches the predetermined or calibratable amount, the control circuit 36 can be programmed to modify the noted threshold indicating a change from Forward State 62 to Forward-to-Neutral State 68 by a predetermined or calibratable amount. For example, the threshold can be modified by 50 ADC counts, thus requiring the shift sensor 48 to indicate to the control circuit 36 that the shift linkage 28 has moved an amount equivalent to an additional 50 ADC counts before the control circuit 36 commands initiation of the noted shift interrupt control strategy. The control circuit 36 is thus programmed to modify the threshold indicating a change from Forward State 62 to Forward-to-Neutral State 68 based upon the value of the position signal generated by the shift sensor 48 until the time when the throttle valve position sensor 46 senses a certain change in position of the throttle valve 34. Thereafter, once the position signal output by the shift sensor 48 reaches the modified threshold indicating a change from the Forward State 62 to the Forward-to-Neutral State 68, the control circuit 36 is programmed to enact the noted shift interrupt control strategy.

Figure 5:
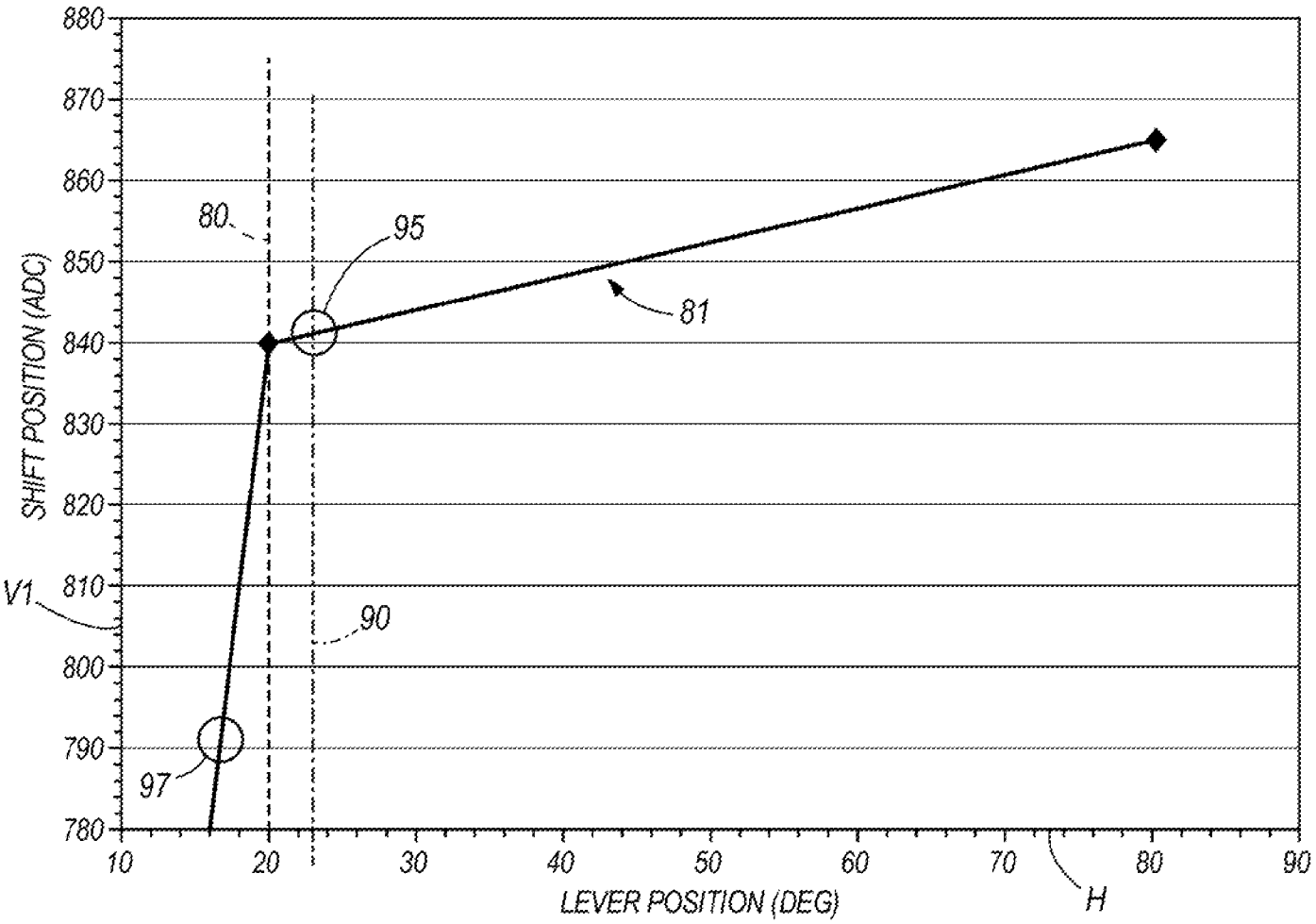
FIG. 5 is a graph depicting sensed movement of a shift linkage and throttle linkage during a shift event, and also depicting modified thresholds for enacting a shift interrupt control strategy.

FIG. 5 shows one example. A dash-and-dot line 90 designates the angular position of the control lever 26 at which the throttle valve 34 reaches a 5% open position, as sensed by the throttle valve position sensor 46. At this point, the shift sensor 48 outputs an 842 ADC count, as shown at circle 95. Until this value is reached, the control circuit 36 is programmed to modify the threshold for enacting the shift interrupt strategy. Here the control circuit 36 is programmed to implement a modified threshold that is 50 ADC different from the 842 ADC (i.e. 792 ADC) as shown at circle 97. Therefore, the control circuit 36 will enact the shift interrupt strategy once the shift sensor 48 outputs 792 ADC. The amount of the modification, which here is 50 ADC, is an amount that can be calibrated and therefore can vary depending upon design criteria for the particular shift control system 10.

Figure 6:
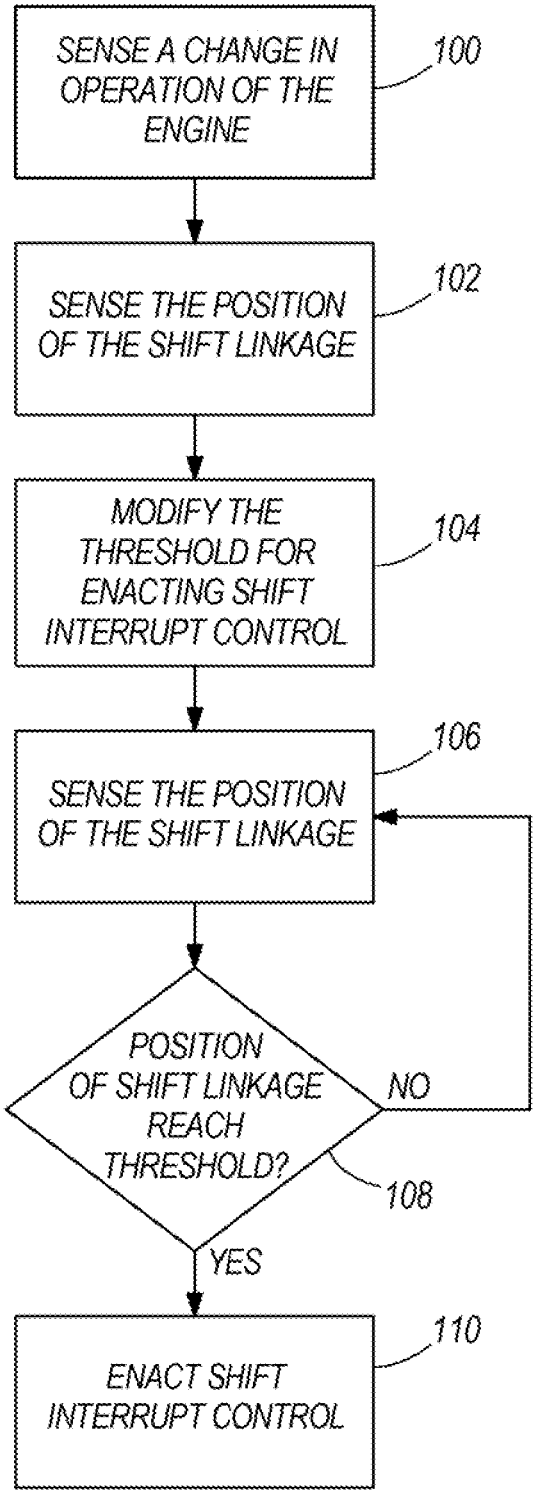
FIG. 6 is a flow chart depicting steps in one example of a method of controlling shift in a marine propulsion device.

FIG. 6 depicts one example of a method of controlling shift in a marine propulsion device, such as marine propulsion device 12. This method can be employed, for example, during a shift from forward gear into neutral gear. Alternately, as described herein above, this method can be employed, for example during a shift from reverse gear into neutral gear. At step 100, the control circuit 36 and throttle valve position sensor 46 are configured to sense a change in operation of the engine 14, which in this example is a change in percent opening of the throttle valve 34. At step 102, the shift sensor 48 senses the current position of the shift linkage 28 and communicates a position signal to the control circuit 36. At step 104, the control circuit 36 is programmed to modify a threshold for enacting a shift interrupt control strategy based upon the information acquired during steps 100 and 102, as described herein above. The threshold can be modified by a predetermined amount, for example 50 ADC or some other amount, which can vary and can be calibrated for each system. At step 106, the control circuit 36 and shift sensor 48 are programmed to sense the position of the shift linkage 28. At step 108, the control circuit 36 compares the sensed position of the shift linkage 28 to the modified threshold that was obtained at step 104. If the position of the shift linkage 28 reaches the modified threshold, at step 110, a shift interrupt control strategy is enacted by the control circuit 36. If the position of the shift linkage has not reached the modified threshold, the control circuit 36 continues to sense the position of the shift linkage at step 106 and make the comparison at step 108.

Referring to FIG. 2, after the shift interrupt control strategy is implemented (in this example at the Forward-to-Neutral State 68), the control circuit 36 can also be programmed to stop enacting the noted shift interrupt control strategy based upon an occurrence of certain criteria. For example, if the shift sensor 48 provides a position signal to the control circuit 36 that reaches the noted threshold indicating a change from the Forward-to-Neutral State 66 to Neutral State 60, the control circuit 36 can stop enacting the shift interrupt control strategy. Alternately, if the control lever 26 is moved back towards the forward gear position 26*d* by a certain amount and the shift sensor 48 provides a position signal to the control circuit 36 that is different than the noted threshold indicating a change from the Forward State 62 to the Forward-to-Neutral State 68 by a certain amount, the control circuit 36 can be programmed to stop enacting the shift interrupt control strategy. These two scenarios will be described further herein below with reference to FIG. 7.

Figure 7:
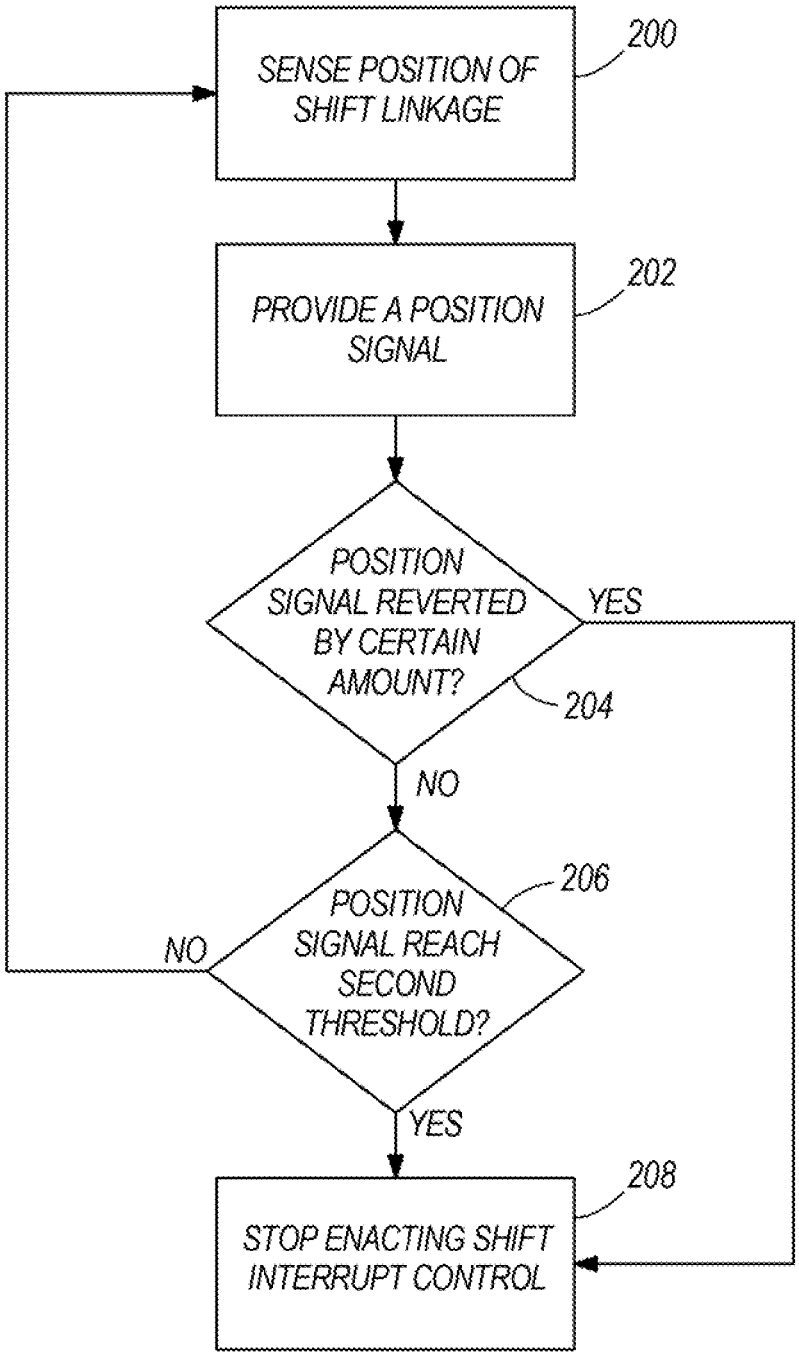
FIG. 7 is a flow chart depicting steps in another example of a method of controlling shift in a marine propulsion device.

FIG. 7 depicts another example of a method of controlling shift in a marine propulsion device, such as the marine propulsion device 12. The example shown in FIG. 7 can be utilized once the control circuit 36 has begun a shift interrupt control strategy at the Forward-to-Neutral State 68 or the Reverse-to-Neutral State 72. At step 200, the shift sensor 48 senses the position of shift linkage 28. At step 202, the shift sensor 48 provides a position signal to the control circuit 36 representing the current position of the shift linkage 28. At step 204, the control circuit 36 compares the position signal provided by the shift sensor 48 to a threshold for reverting back to a previous gear position. The threshold can vary and can be calibrated for the particular system in which the method is employed. If the position signal sensed at step 202 has reverted by the certain amount, the control circuit 36 is configured to stop enacting shift interrupt control at step

208. If the position signal has not reverted by the noted amount, at step 206, the control circuit 36 compares the position signal provided by shift sensor 48 to a second threshold for determining whether a shift change from Forward-to-Neutral State 68 to Neutral State 60 is reached. The second threshold is can vary and can be calibrated for the particular system in which the method is employed. If the second threshold is reached, the control circuit 36 is programmed to stop enacting the shift interrupt control strategy 208. If not, the control circuit 36 and shift sensor 48 continue sensing the position of the shift linkage at step 200.

What is claimed is:

1. A shift control system for a marine propulsion device, the system comprising:

a control lever;

a shift linkage operably connected with the control lever so as to cause a shift change in the marine propulsion device upon movement of the control lever;

a shift sensor outputting a position signal representing a current position of the shift linkage; and a control circuit that is programmed to identify an impending shift change when the position signal reaches a first threshold and an actual shift change when the position signal reaches a second threshold;

wherein the control circuit is programmed to enact a shift interrupt control strategy that facilitates the shift change when the position signal reaches the first threshold; and wherein the control circuit is programmed to actively modify the first threshold as a change in operation of the marine propulsion device occurs.

2. The system according to claim 1, further comprising a throttle valve position sensor sensing a position of a throttle valve on a marine engine associated with the marine propulsion device, wherein the change in operation of the marine propulsion device is a change in position of the throttle valve, sensed by the throttle valve position sensor.

3. The system according to claim 2, wherein the control circuit is programmed to modify the first threshold based on a value of a position signal generated by the shift sensor until the throttle valve position sensor senses a certain amount of change in position of the throttle valve.

4. The system according to claim 1, wherein the shift sensor comprises a potentiometer and an electronic converter that outputs digital counts, and wherein the shift sensor outputs a digital count corresponding to a current position of the shift linkage.

5. The system according to claim 1, wherein when the position signal reaches the modified first threshold, the control circuit is programmed to enact the shift interrupt control strategy.

6. The system according to claim 5, further wherein the control circuit is programmed to thereafter stop enacting the shift interrupt control strategy when the shift sensor provides a position signal that is different than the first threshold by a certain amount.

7. The system according to claim 5, further wherein the control circuit is programmed to thereafter stop enacting the shift interrupt control strategy when the position signal reaches the second threshold.

8. The system according to claim 1, wherein the shift change is from a forward gear to a neutral gear.

9. The system according to claim 1, wherein the shift interrupt control strategy comprises modifying a timing of an ignition event in a marine engine associated with the marine propulsion device.

10. The system according to claim 9 wherein the shift interrupt control strategy comprises modifying a timing of spark in the marine engine without causing misfire.

11. The system according to claim 1, wherein the shift interrupt control strategy comprises cutting fuel to certain cylinders in a marine engine associated with the marine propulsion device.

12. A system for controlling shift in a marine propulsion device having an internal combustion engine, the system comprising:

a throttle valve position sensor that senses a change in position of a throttle valve of the internal combustion engine;

a shift sensor that senses a position of a shift linkage when the change in position of the throttle valve is sensed;

a control circuit that receives the position of the shift linkage from the shift sensor; and wherein the control circuit is configured to modifying, based upon the position of the shift linkage when the change in position of the throttle valve is sensed, a position threshold upon which the control circuit is configured to initiate a change in engine speed to facilitate a shift event.

13. The system according to claim 12, wherein the control circuit is configured to continue to modify the position threshold upon which the control circuit is configured to initiate the change in engine speed to facilitate the shift event until the position of the throttle valve changes by a certain amount.

14. A system for controlling shift in a marine propulsion device having an internal combustion engine, the system comprising:

a first sensor that senses a change in operation of the internal combustion engine;

a second sensor that senses a current position of a shift linkage in the marine propulsion device when the change in operation of the internal combustion engine occurs;

a control circuit that receives a position signal from the second sensor representing the current position of the shift linkage; and wherein the control circuit is configured to i) identify an impending shift change when the position signal reaches a first position threshold and a shift change when the position signal reaches a second position threshold;

ii) enact a shift interrupt control strategy that facilitates the actual shift change when the position signal reaches the first position threshold; and iii) actively modify the first position threshold when the change in operation of the internal combustion engine occurs.

15. The system according to claim 14, wherein the internal combustion engine comprises a throttle valve, and wherein the first sensor comprises a throttle valve position sensor, and wherein the change in operation of the internal combustion engine is a change in position of the throttle valve that is sensed by the throttle valve position sensor.

16. The system according to claim 15, wherein the second sensor comprises a shift sensor that senses the current position of a shift linkage and wherein the control circuit is configured to actively modify the first threshold based on a value of a position signal generated by the shift sensor until the throttle valve position sensor senses a certain amount of change in position of the throttle valve.

17. The system according to claim 14, wherein the control circuit is further configured to enact the shift control strategy once the position signal reaches the first position threshold.

18. The system according to claim 17, wherein the control circuit is further configured to stop enacting the shift interrupt control strategy when the position signal reverts back away from the first position threshold by a certain amount.

19. The system according to claim 17, wherein the control circuit is further configured to stop enacting the shift interrupt control strategy when the position signal reaches the second position threshold.

20. The system according to claim 14, wherein the control circuit is further configured to modify a timing of spark in the internal combustion engine as part of the shift interrupt control strategy.

* * * * *